US007419152B2

(12) United States Patent
Adachi

(10) Patent No.: US 7,419,152 B2
(45) Date of Patent: Sep. 2, 2008

(54) SHEET FEEDING APPARATUS AND IMAGE FORMING APPARATUS

(75) Inventor: Seiichiro Adachi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 271 days.

(21) Appl. No.: 11/275,790

(22) Filed: Jan. 30, 2006

(65) Prior Publication Data

US 2006/0175746 A1 Aug. 10, 2006

(30) Foreign Application Priority Data

Feb. 4, 2005 (JP) ..... 2005-029806

(51) Int. Cl.
*B65H 3/14* (2006.01)

(52) U.S. Cl. ..... 271/97; 271/98; 271/31

(58) Field of Classification Search ..... 271/97, 271/98, 31
See application file for complete search history.

(56) References Cited

U.S. PATENT DOCUMENTS

| | | | | |
|---|---|---|---|---|
| 3,511,495 | A * | 5/1970 | Schonfeld | 271/97 |
| 6,015,144 | A * | 1/2000 | Yoshii et al. | 271/97 |
| 2004/0089994 | A1 * | 5/2004 | Koga et al. | 271/98 |
| 2004/0100013 | A1 * | 5/2004 | Mathewson | 271/98 |
| 2006/0175746 | A1 | 8/2006 | Adachi | 271/97 |

FOREIGN PATENT DOCUMENTS

JP 2004-142881 5/2004

* cited by examiner

*Primary Examiner*—David H Bollinger
(74) *Attorney, Agent, or Firm*—Fitzpatrick, Cella, Harper & Scinto

(57) ABSTRACT

When a top sheet of a sheet stack stacked on a sheet tray capable of moving up and down is fed by sheet feeding device, air is blown to the end face of the sheet stack by air blowing device for improving a separation characteristic. The quantity of blown air for the top sheet to rise by a specified amount is determined based on a signal from rising sheet detecting device for detecting the top sheet rising by air blown by the air blowing device, and air is blown based on the determined air quantity when the sheet is fed by the sheet feeding device.

9 Claims, 15 Drawing Sheets

FIG. 12

| | | | | | | | | | |
|---|---|---|---|---|---|---|---|---|---|
| EQUAL TO OR GREATER THAN 80% | 30 SEC | 30 SEC | 30 SEC | 30 SEC | 30 SEC | 30 SEC | 50 SEC | 50 SEC | 50 SEC |
| 70% | 30 SEC | 30 SEC | 30 SEC | 30 SEC | 30 SEC | 30 SEC | 30 SEC | 30 SEC | 30 SEC |
| 60% | 20 SEC | 20 SEC | 20 SEC | 20 SEC | 20 SEC | 30 SEC | 30 SEC | 30 SEC | 30 SEC |
| 50% | 10 SEC | 10 SEC | 15 SEC | 15 SEC | 15 SEC | 20 SEC | 20 SEC | 20 SEC | 20 SEC |
| 45% | 5 SEC | 5 SEC | 10 SEC | 10 SEC | 10 SEC | 15 SEC | 15 SEC | 15 SEC | 15 SEC |
| 40% | 0 SEC | 5 SEC | 5 SEC | 5 SEC | 5 SEC | 5 SEC | 5 SEC | 10 SEC | 10 SEC |
| EQUAL TO OR LESS THAN 30% | 0 SEC | 0 SEC | 0 SEC | 5 SEC | 5 SEC | 5 SEC | 5 SEC | 5 SEC | 5 SEC |
| HUMIDITY / TEMPERATURE | EQUAL TO OR LESS THAN 5℃ | 10℃ | 15℃ | 20℃ | 30℃ | 40℃ | 45℃ | 50℃ | EQUAL TO OR GREATER THAN 60℃ |

INITIAL SWING TIME (T1) CONTROL TABLE

FIG. 13

| EQUAL TO OR GREATER THAN 80% | 10 SEC | 10 SEC | 10 SEC | 10 SEC | 1 0 SEC | 10 SEC | 10 SEC | 10 SEC | 10 SEC |
|---|---|---|---|---|---|---|---|---|---|
| 70% | 8 SEC | 8 SEC | 8 SEC | 8 SEC | 8 SEC | 10 SEC | 10 SEC | 10 SEC | 10 SEC |
| 60% | 5 SEC | 5 SEC | 5 SEC | 5 SEC | 5 SEC | 8 SEC | 8 SEC | 8 SEC | 8 SEC |
| 50% | 5 SEC | 5 SEC | 5 SEC | 5 SEC | 5 SEC | 5 SEC | 5 SEC | 5 SEC | 5 SEC |
| 45% | 3 SEC | 3 SEC | 3 SEC | 3 SEC | 5 SEC | 5 SEC | 5 SEC | 5 SEC | 5 SEC |
| 40% | 2 SEC | 2 SEC | 2 SEC | 2 SEC | 2 SEC | 2 SEC | 4 SEC | 4 SEC | 4 SEC |
| EQUAL TO OR LESS THAN 30% | 0 SEC | 0 SEC | 0 SEC | 0 SEC | 0 SEC | 0 SEC | 0 SEC | 0 SEC | 0 SEC |
| HUMIDITY / TEMPERATURE | EQUAL TO OR LESS THAN 5℃ | 10℃ | 15℃ | 20℃ | 30℃ | 40℃ | 45℃ | 50℃ | EQUAL TO OR GREATER THAN 60℃ |

PRE-JOB SWING TIME (T2) CONTROL TABLE

FIG. 14

| EQUAL TO OR GREATER THAN 80% | 85℃ | 85℃ | 85℃ | 85℃ | 85℃ | 85℃ | 85℃ | 85℃ | OFF |
|---|---|---|---|---|---|---|---|---|---|
| 70% | 80℃ | 80℃ | 80℃ | 80℃ | 85℃ | 85℃ | 85℃ | 85℃ | OFF |
| 60% | 70℃ | 70℃ | 70℃ | 70℃ | 80℃ | 80℃ | 80℃ | 80℃ | OFF |
| 50% | 65℃ | 65℃ | 65℃ | 65℃ | 65℃ | 70℃ | 70℃ | 70℃ | OFF |
| 45% | 60℃ | 60℃ | 60℃ | 60℃ | 60℃ | 65℃ | 65℃ | 65℃ | OFF |
| 40% | OFF | OFF | OFF | OFF | OFF | OFF | OFF | OFF | OFF |
| EQUAL TO OR LESS THAN 30% | OFF | OFF | OFF | OFF | OFF | OFF | OFF | OFF | OFF |
| HUMIDITY / TEMPERATURE | EQUAL TO OR LESS THAN 5℃ | 10℃ | 15℃ | 20℃ | 30℃ | 40℃ | 45℃ | 50℃ | EQUAL TO OR GREATER THAN 60℃ |

TABLE FOR TEMPERATURE-CONTROL BY HEATER 6 WHEN COATED SHEET IS USED

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and particularly to a configuration for separating sheets having a high adhesiveness between sheets by air.

2. Related Background Art

Conventional image forming apparatuses such as copiers and printers have a sheet feeding apparatus delivering sheets stacked on sheet stacking means from the top one after another by a pickup roller as sheet feeding means, and separating the sheets one by one by a separation portion and feeding the same to an image forming portion.

If sheets are continuously fed in such a sheet feeding apparatus, cut sheets are used, but such cut sheets are normally limited to fine papers and plain papers specified by copier makers. For reliably separating such sheets one by one and feeding the same, various separation systems have been employed, and such separation systems include, for example, a separation pad system in which a feed roller is brought into contact with a friction member with a predetermined pressure to prevent double feeding.

Other separation systems include a retard separation system having a feed roller rotating in a sheet conveying direction, and a separation roller driven in a direction opposite to the sheet conveying direction with a predetermined torque and brought into contact with the feed roller with a predetermined pressure. In this system, only the top sheet of a sheet stack delivered by the pickup roller is allowed to pass, and other sheets delivered along with the top sheet are fed back to the sheet stacking means side, whereby double feeding is prevented.

For reliably separating and feeding sheets by these separation systems, for example, in the case of the retard separation system, sheets can reliably be separated one by one by optimizing a back torque and an applied pressure of the separation roller with consideration given to the frictional force of sheets to be fed.

In recent years, with diversification of sheets (recording media), demands for formation of images not only on OHP sheets, art films and the like but also on sheets such as coated sheets with the surface of the sheet subjected to a coating treatment for giving a whiteness and a gloss in response to market needs for colorization have increased.

However, when a very thick sheet is to be fed, it may be impossible to pick up the very thick sheet with its self weight posing a resistance to conveyance, resulting in a jam. For sheets composed of resin materials which are easily charged, like OHP sheets and art films, sheets mutually rub to gradually charge the surfaces of the sheets, and the sheets mutually adhere with a coulomb force during a feed operation under a low-humidity environment. Therefore, for these sheets, it may be impossible to pick up the sheet, or double feeding may occur.

For sheets with the surface of the sheet coated with a coating material consisting of paints and the like, sheets are mutually attracted in nature particularly when stacked in an environment under high humidity, and therefore it may be impossible to pick up the sheet, or double feeding may frequently occur.

In the case of these special sheets, the frictional force between sheets is in itself equivalent to or less than the frictional force for plain papers. However, due to an attracting force by frictional charging under a low-humidity environment in the case of resin material sheets, and an attracting force under a high-humidity environment in the case of coated sheets, sheets are attracted with a force much greater than the frictional force between sheets, and therefore cannot be fully separated by the conventional separation system. Namely, in the case of the conventional separation system, only the frictional force between sheets is considered, and therefore sheets cannot be reliably separated if such an attracting force other than the frictional force acts.

Thus, for releasing such a very high attracting force between sheets, there is a technique disclosed in, for example, Japanese Patent Application Laid-Open No. 2004-142881. In this technique, sheets are loosened in advance by blowing air to the side face of a sheet stack to eliminate attraction between the sheets, the sheets are then picked up one by one in descending order of the position of the sheet, and the sheets are separated one by one by a separation portion provided in the downstream. Apparatuses employing such a separation and feeding system are employed in the printing industry and some of copiers. In the separation and feeding system having such means for blowing air to the side face of the sheet stack (hereinafter referred to as auxiliary air loosening means), even sheets (recording media) having a high attracting force as described above can be loosened to eliminate the attraction before feeding the sheets. Therefore, the separation performance is improved compared to the aforementioned system using only a frictional force.

FIG. 15 shows the configuration of a sheet feeding apparatus comprising such auxiliary air loosening means. Feeding a sheet S on a sheet stacking mount 60, the sheet feeding apparatus first lifts the sheet stacking mount 60 until the sheet S1 at the top on the sheet stacking mount is detected by a sensor (not shown), and temporarily stops the sheet stacking mount 60 when the sensor detects the topmost sheet S1.

After the sheet stacking mount 60 is thus stopped, air is blown in the direction shown by the arrow from auxiliary air loosening means (not shown), whereby the front end of the top sheet S1 on the sheet stacking mount is raised. After the front end of the top sheet S1 is thus raised to separate the sheet, the sheet feeding apparatus lifts the sheet stacking mount 60 until the front end of the sheet is detected by a sensor constituted by a light emitting portion 61 and a light receiving portion 62. In this way, an adjustment is made so that a distance between the front end of the top sheet S1 and a sheet attracting and conveying belt allows the sheet attracting and conveying belt to reliably attract the sheet S1.

In such a conventional sheet feeding apparatus blowing air to the side face of the sheet stack, in the case of a sheet having a high attracting force and a large thickness, strong air, in other words, a large quantity of air (high-speed air) should be blown for reliably raising the sheet to separate it because the sheet is heavy especially under a high-humidity environment.

Even the same sheet may have a low attracting force depending on storage conditions, and in the case of a sheet having a low attracting force and a small thickness, the sheet can sufficiently be raised with weak air, in other words, a small quantity of air especially under a low-humidity environment. In the case of such a sheet, the sheet falls into disorder in a sheet stacking portion if the quantity of air is too large.

If the sheet thus falls into disorder, so called skew conveying in which the sheet is conveyed on the skew, so called a lateral registration shift in which the sheet is shifted in a direction perpendicular to the conveyance direction, or the like occurs, and the sheet cannot appropriately be conveyed.

If the sheet cannot appropriately be conveyed as described above, an image cannot appropriately be formed on the sheet.

SUMMARY OF THE INVENTION

The present invention has been made in view of the situations described above, and an object thereof is to provide a sheet feeding apparatus capable of eliminating attraction between sheets irrespective of the type of sheet and the environment and appropriately feeding the sheets, and an image forming apparatus comprising the sheet feeding apparatus.

The present invention is a sheet feeding apparatus comprising:

a sheet tray capable of moving up and down;

sheet feeding device capable of sheet feeding operation for feeding a top sheet of a sheet stack supported on said sheet tray; and air blowing device capable of blowing air to the end face of said sheet stack, wherein said sheet tray is lifted until the top sheet of the sheet stack reaches a specified position, air is then blown by said air blowing device to raise the top sheet, a quantity of air blown by said air blowing device at the sheet feeding operation is determined based on a quantity of air blown by said air blowing device as amount of rising of the top sheet by blowing air becomes a specified amount.

BRIEF DESCRIPTION OF THE DRAWINGS

FIG. 12 shows one example of a control table for initial swing time;

FIG. 13 shows one example of a control table for pre-job swing time;

FIG. 14 shows one example of a table for temperature-control by a heater.

DETAILED DESCRIPTION OF THE PREFERRED EMBODIMENTS

Best embodiments for carrying out the present invention will be described in detail below using the drawings.

Figure 1:
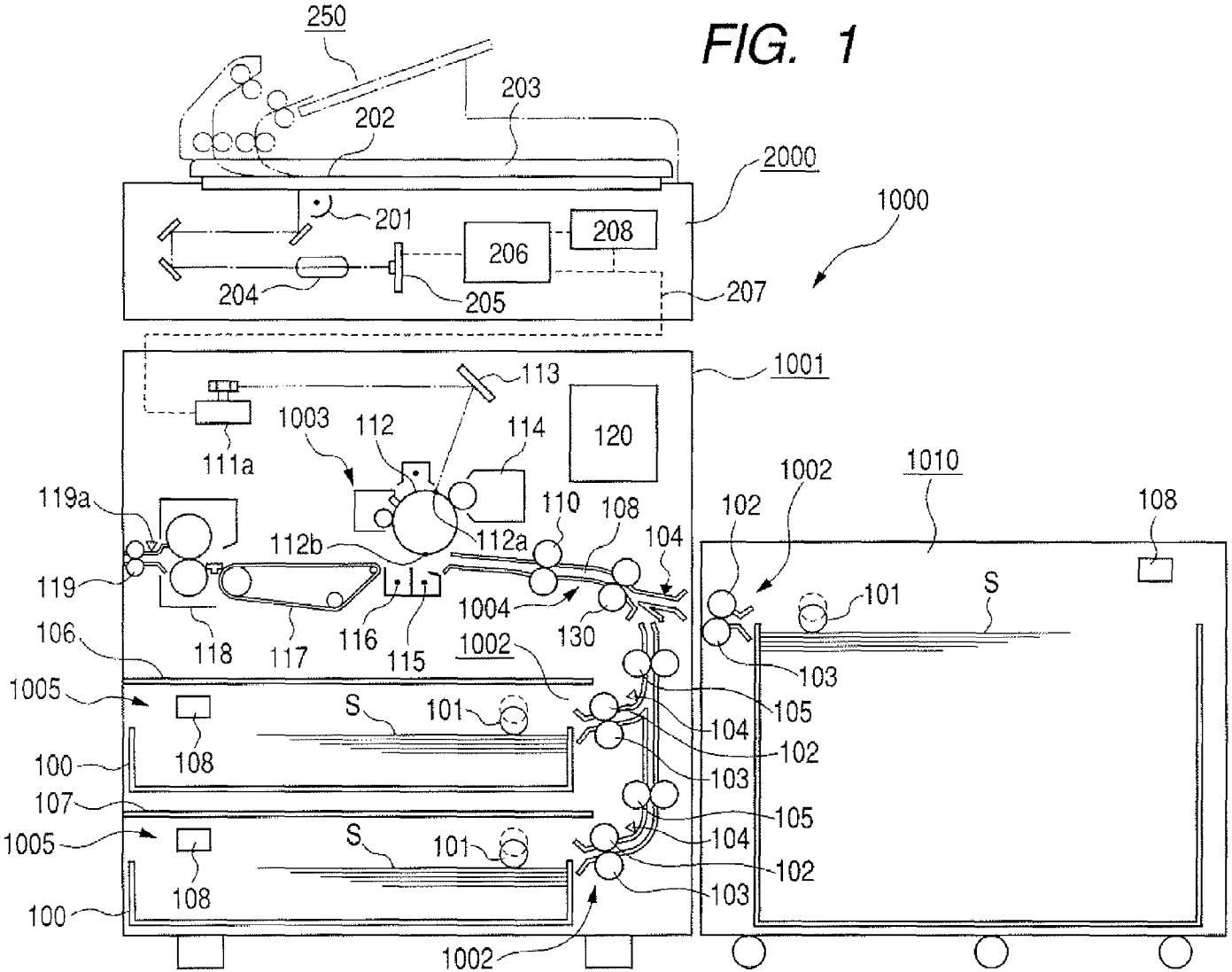
FIG. 1 is a sectional view of a printer which is one example of an image forming apparatus comprising a sheet feeding apparatus according to an embodiment of the present invention.

FIG. 1 is a sectional view of a printer as one embodiment of an image forming apparatus comprising a sheet feeding apparatus according to an embodiment of the present invention.

In this figure, reference numeral 1000 denotes a printer, and the printer 1000 comprises a printer main body 1001 and a scanner 2000 placed on the top surface of the printer main body 1001.

The scanner 2000 for reading an original comprises a scanning optical system light source 201, an original plate 202, an opening and closing original pressure plate 203, a lens 204, a light receiving element (photoelectric conversion) 205, an image processing portion 206, a memory portion 208 for storing image processing signals processed by the image processing portion 206, and the like.

For reading an original, an original (not shown) stacked on the original plate 202 is irradiated with light by the scanning optical system light source 201 and thereby read. An image of the read original is processed by the image processing portion 206, then converted into an electrically encoded electric signal 207, and sent to a laser scanner 111*a* as image forming means. Image information processed by the image processing portion 206 and encoded may be stored temporarily in the memory portion 208, and sent to the laser scanner 111*a* with a signal from a controller 120 described later as necessary.

The printer main body 1001 comprises a sheet feeding apparatus 1002 feeding a sheet S, a sheet conveying apparatus 1004 conveying to an image forming portion 1003 the sheet S fed by the sheet feeding apparatus 1002, the controller 120 as control means for controlling the printer 1000, and the like.

The sheet feeding apparatus 1002 comprises cassettes 100, pickup rollers 101 as sheet feeding device, and separation portions each consisting of a feed roller 102 and a retard roller 103. The sheet S in the cassette 100 is separated and fed one by one by the actions of the pickup roller 101 moving up and down and rotating in predetermined timing and the separation portion. A sheet feed sensor 104 is provided near the downstream side in the sheet conveying direction of the feed roller 102 and the retard roller 103, and passage of the sheet S can be detected by the sheet feeding sensor 104.

A Cassette housing portion 1005 housing the cassette 100 is provided in the lower part of the printer main body 1001, and the cassette housing portion 1005 is partitioned by partition plates 106 and 107, and sealed in a predetermined tightness. Temperature and humidity sensors 108 as temperature and humidity detecting means for a temperature and a humidity around the cassette in the housing portion are each placed in the cassette, and can detect a temperature and a humidity in each cassette housing portion 1005 independently.

Reference numeral 1010 denotes a large-capacity paper deck which is detachably attachable as an option, and the paper deck 1010 is provided with the sheet feeding apparatus 1002 having a configuration same as that of the printer main body 1001, and a sheet tray (not shown) capable of moving up and down. The paper deck 1010 is sealed in a predetermined tightness and provided with a temperature and humidity sensor 108 detecting a temperature and a humidity in a deck portion.

The sheet conveying apparatus 1004 comprises a conveying roller pair 105, and a registration roller portion having a pre-registration roller pair 130 and a registration roller pair 110. The sheet S fed from the sheet feeding apparatus 1002 is guided to the registration roller pair 110 by the conveying roller pair 105 after passing through a sheet conveying pathway 108 constituted by a guide plate. Further, the sheet S is then conveyed to the image forming portion 1003 by the registration roller pair 110.

The image forming portion 1003 comprises a photosensitive drum 112, a laser scanner 111*a*, a developing device 114, a transferring charging device 115, a separating charging device 116 and the like. For forming an image, laser light from the laser scanner 111*a* is reflected back by a mirror 113 and thereby applied to an exposure position 112*a* on the photosensitive drum rotating clockwise, whereby a latent image is formed on the photosensitive drum. Further, the latent image thus formed on the photosensitive drum is then visualized as a toner image by a developing device 114.

The toner image on the photosensitive drum is then transferred onto the sheet S by the transferring charging device 115 in a transferring portion 112*b*. Further, the sheet S onto which the toner image has been thus transferred is electrostatically separated from the photosensitive drum 112 by the separating charging device 116, then conveyed to a fixing apparatus 118 by a conveying belt 117 to fix the toner image, and then discharged by a discharging roller 119. A sheet discharge sensor 119*a* is provided in a conveying pathway between the fixing apparatus 113 and the discharging roller 119, and passage of the discharged sheet S can be detected by the sheet discharge sensor 119*a*.

In this embodiment, the printer main body 1001 is separate from the scanner 2000, but the printer main body 1001 may be integral with the scanner 2000. Irrespective of whether the printer main body 1001 is separate from or integral with the scanner 2000, it functions as a copier if a processing signal of the scanner 2000 is input to the laser scanner 111*a*, and it functions as a facsimile if a transmission signal of facsimile is input. Further, the printer main body 1001 functions as a printer if an output signal of a personal computer is input. Conversely, the printer main body 1001 functions as a facsimile if a processing signal of the image processing portion 206 of the scanner 2000 is sent to another facsimile. The original can be automatically read if an original automatic delivering apparatus 250 shown with the two-dot chain line is mounted in place of the pressure plate 203 in the scanner 2000.

Figure 2:
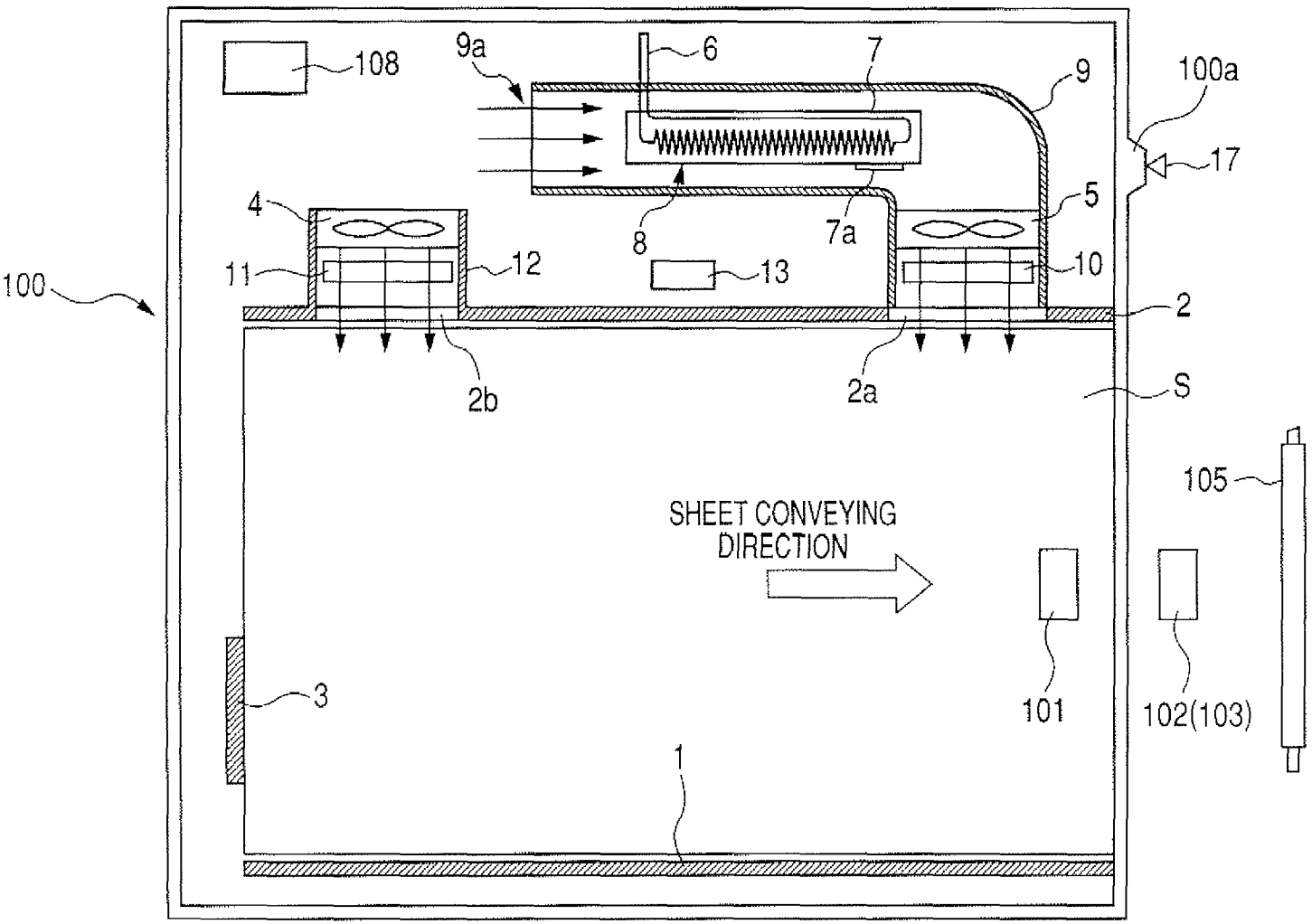
FIG. 2 is a plan view showing the configuration of the sheet feeding apparatus.
Figure 3:
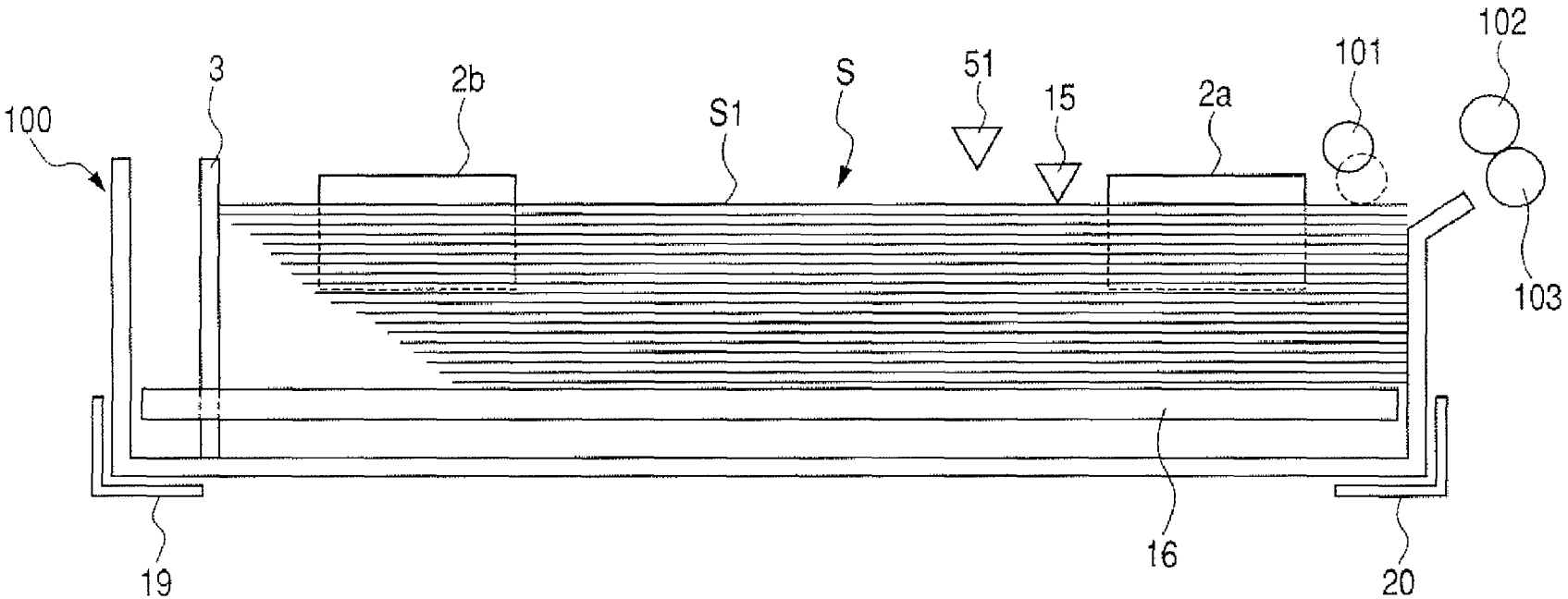
FIG. 3 is a sectional side elevation view of the sheet feeding apparatus.
Figure 4:
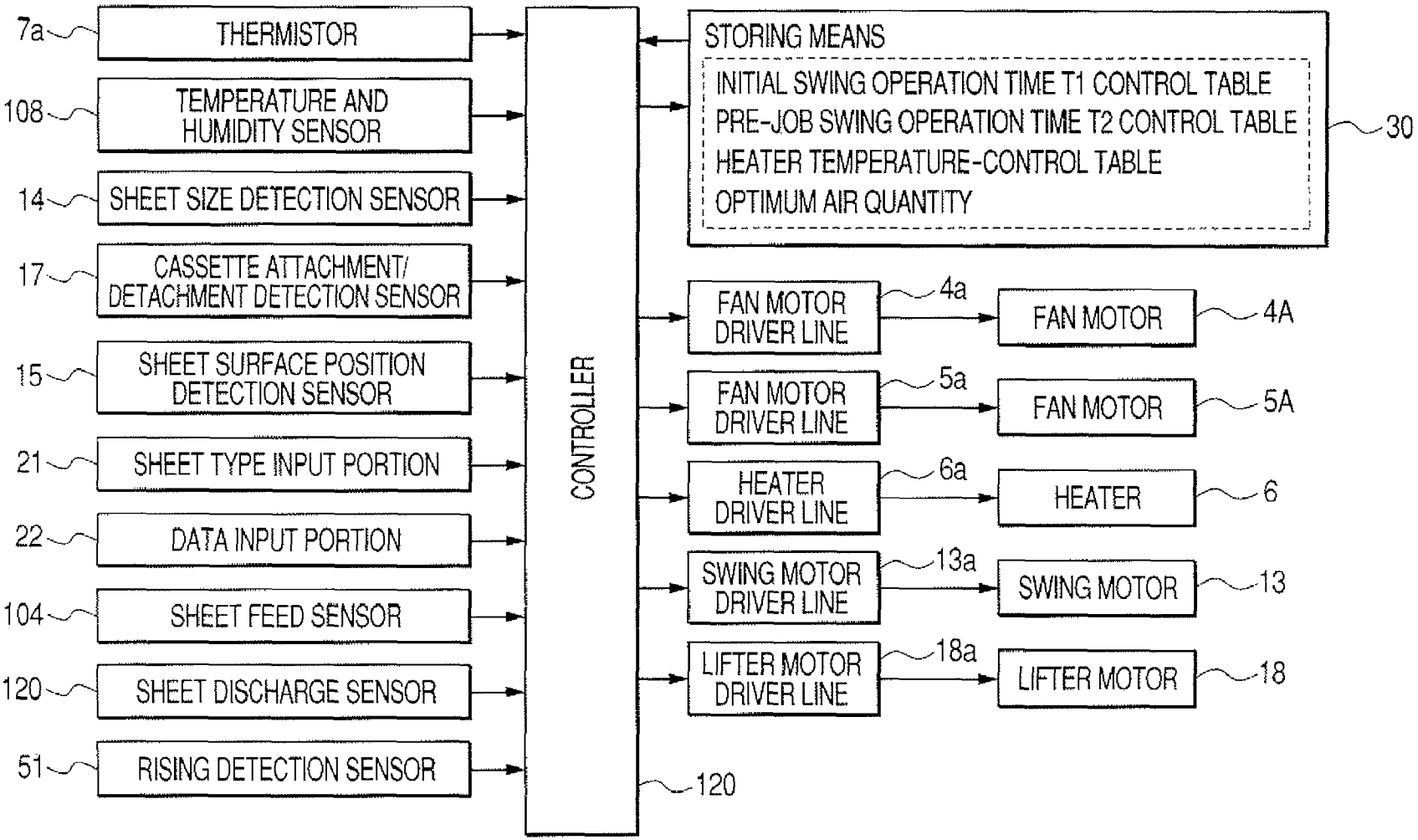
FIG. 4 is a block diagram of the printer.

FIG. 2 is a plan view showing the configuration of the sheet feeding apparatus 1002, FIG. 3 is a sectional side elevation view of the apparatus, and FIG. 4 is a block diagram of control. As shown in FIG. 4, the controller 120 controls a motor and a heater via drivers based on detection signals and input signals from sensors and input means. The controller 120 may be mounted on the paper deck 1010 or may be mounted on the printer main body 1001.

In FIG. 2, reference numerals 1 and 2 denote side regulating plates as regulating members for regulating the position of the sheet stacked and housed in the cassette 100 in the width direction, and the side regulating plates 1 and 2 are configured to be movable along the width direction according to the size of the sheet S. Reference numeral 3 denotes a rear end regulating plate for regulating the rear end position of the sheet S in the sheet conveying direction, and the rear end regulating plate 3 is configured to be movable along the sheet conveying direction according to the size of the sheet S.

The cassette 100 can be taken out along rails 19 and 20 shown in FIG. 3, and when a user sets the sheet S, the cassette 100 can be taken out from the printer main body 1001 to the front. The cassette 100 is provided with a raised portion 100*a* as shown in FIG. 2, and when the cassette 100 is housed in the cassette housing portion 1005, the raised portion 100*a* is detected by a cassette attachment/detachment sensor 17 provided in the cassette housing portion 1005.

A detection signal from the cassette attachment/detachment detection sensor 17 is sent to the controller 120. The controller 120 can detect whether the cassette 100 is attached to the cassette housing portion 1005 or taken out therefrom based on the detection signal from the cassette attachment/detachment detection sensor 17.

A sheet tray 16 capable of moving up and down for stacking the sheet S is provided in the cassette 100 as shown in FIG. 3, and the sheet tray 16 is moved up and down by a lifter motor 18 shown in FIG. 4 according to attachment/detachment of the cassette 100.

For example, when the cassette 100 in which the sheet S is set is housed by the user and this state is detected by a signal from the cassette attachment/detachment detection sensor 17, the controller 120 drives the lifter motor 18 to lift the sheet tray 16. When the cassette 100 is taken out for setting the sheet and this state is detected by a signal from the cassette attachment/detachment detection sensor 17 the lifter motor 18 operates to lower the sheet tray 16 to a lower limit position.

A sheet surface position detection sensor 15 for detecting whether the position of the surface of the top sheet stacked on the sheet tray 16 is at a proper level, namely it has reached a position allowing the sheet to be fed, is provided in the upper part of the cassette housing portion 1005.

When the sheet tray 16 is lifted, the lifter motor 18 rotates until the sheet surface position detection sensor 15 as sheet position detecting device detects the top sheet S1. When the sheet position detection sensor 15 detects the top sheet S1, the controller 120 stops the lifter motor 18 based on a detection signal from the sheet surface position detection sensor 15. In this way, a proper sheet surface level is maintained.

When the sheet S is fed one after another in descending order of the position with the feeding operation, the sheet surface level is gradually lowered, and the sheet surface position detection sensor 15 is turned OFF, the controller 120 drives the lifter motor 18 in a direction causing the sheet tray 16 to be lifted again. In this way, the sheet surface level can be controlled to fall within a fixed range at all times.

An attraction phenomenon occurs under a high-humidity if the sheet S is a coated sheet as described previously. As a mechanism for such attraction of coated sheets under a high-humidity, the coated sheet takes up moisture to swell or extend to cause generation of a negative pressure, and therefore if air is made to flow in between coated sheets to eliminate the negative pressure, the attraction phenomenon can be eliminated. Further, by setting the flowing air at a high temperature to dehumidify and dry the coated sheet having taken up moisture, swelling can be prevented, whereby a phenomenon in which coated sheets are mutually attracted again can be inhibited.

Thus, in this embodiment, for making air flow in between coated sheets as described above, a plurality of (two in this embodiment) air blowing ports 2*a* and 2*b* are formed in the side regulating plate 2 on the back side in the width direction, of the side regulating plates 1 and 2, as shown in FIGS. 2 and 3. The air blowing ports 2*a* and 2*b* are formed with a predetermined spacing in the sheet conveying direction and at positions in height in which the ports face the side face of at least the sheet S situated at a position allowing the sheet to be fed. The air blowing ports 2*a* and 2*b* are provided with ducts 9 and 12 having fans 4 and 5 as air blowing device mounted therein, and air is blown to the sheet S through the air blowing ports 2*a* and 2*b* by the fans 4 and 5.

When air is thus blown, the sheet S rises from a sheet stack surface, and when the amount of rising reaches a predetermined height, it is detected by a rising detection sensor 51 as rising sheet detecting device placed above the sheet surface position detection sensor 15.

Shutters 10 and 11 are provided between the fans 4 and 5 and the air blowing ports 2*a* and 2*b* such that the shutters can move up and down, and the shutters 10 and 11 can be moved up and down by a swing motor 13 and an up-and-down moving mechanism (not shown). When air is blown to the sheet S, the shutters 10 and 11 are gradually moved up and down to swing blown air, whereby air is blown in between sheets in succession, and the effect of loosening sheets can be improved.

Fan motors 4A and 5A driving the fans 4 and 5 and the swing motor 13 are independently driven by signals from the controller 120 input via fan motor driver circuits 4*a* and 5*a* and a swing motor driver circuit 13*a* shown in FIG. 4.

The fan motors 4A and 5A can have their rotation speed changed by, for example, changing an applied voltage by a control signal from the controller 120 as blowing force controlling means. In this way, the air blowing strength of the fans 4 and 5 as air blowing device, i.e. the strength of air blown by the fans 4 and 5, can be changed.

Further, air heating means 8 as heating means consisting of a heater 6 and a heat sink 7 is provided near an air intake port 9*a* of the duct 9 provided in the air blowing port 2*a* on the pickup roller side as shown in FIG. 2. By the air heating means 8 provided on the upstream side in the air blowing direction of the fan 5, air taken along the direction shown by the arrow from the air intake port 9*a* can be heated before, and then blown from the air blowing port 2*a*.

A thermistor 7*a* detecting the temperature of the surface of the heat sink is mounted on the heat sink 7, and a detection signal of the thermistor 7*a* is sent to the controller 120 as shown in FIG. 4. The controller 120 can control the temperature of hot air from the air blowing port 2*a* by performing ON/OFF control of the heater 6 of the air heating means 8 via the driver circuit 6*a* in response to the detection signal from the thermistor 7*a*.

As shown in FIG. 2, the fans 4 and 5, the ducts 9 and 12, the air heating means 8, the shutters 10 and 11, and the like are all integrally mounted on the side regulating plate 2 on the back side in the width direction. Resultantly, even if the sheet S is changed from the sheet having the size shown in FIG. 2 to a sheet $S_2$ having a smaller size shown in FIG. 5, the fan 5 and the like accordingly move integrally with the side regulating plate 2 on the back side in the width direction, and therefore a positional relationship with the end portion of the sheet $S_2$ can always be retained.

In this embodiment, an apparatus stacking sheets on a center basis is described, and therefore the fan 5 and the like move integrally with the side regulating plate 2, but a fan and the like may be mounted on the side regulating plate on the fixed side in the case of an apparatus stacking sheets on a one-side basis.

Figure 5:
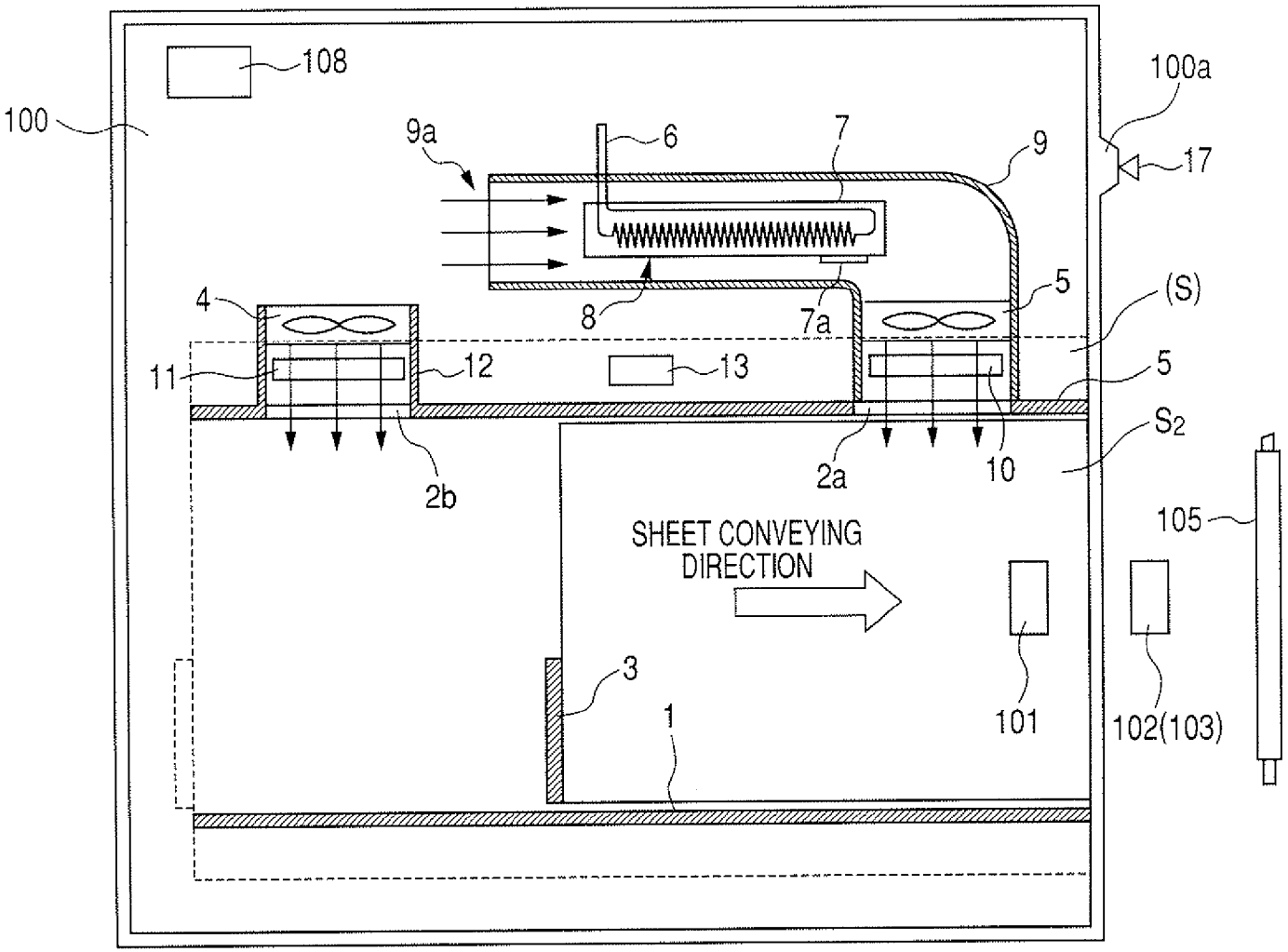
FIG. 5 is a plan view showing a state of the sheet feeding apparatus housing a small-size sheet.

If the rear end position of the sheet $S_2$ does not reach the air blowing port 2*b* in the downstream in the sheet conveying direction like the sheet $S_2$ having the smaller size shown in FIG. 5, air blown by the fan 4 becomes useless even though the fan 4 is driven.

Thus, a sheet size information signal is output from a sheet size detection sensor 14 shown in FIG. 4, which detects a sheet size according to the positions of the side regulating plates 1 and 2 and the rear end regulating plate 3 in the cassette 100. If the controller 120 determines based on the signal that the sheet S housed in the cassette 100 is a sheet having a smaller size, it stops the drive of the fan 4 independently.

Air is thus made to flow in between sheets to eliminate a negative pressure, and air is set at a high temperature to dehumidify and dry the coated sheet having taken up moisture, whereby swelling can be prevented, and a phenomenon in which coated sheets are mutually attracted can be inhibited.

As a characteristic of the coated sheet, its attracting force becomes a maximum immediately after the wrapping paper is unsealed to take out the coated sheet, the coated sheet is housed in the cassette immediately thereafter, and further, this cassette 100 is attached to the cassette housing portion 1005. Hereinbelow, the attraction phenomenon is referred to as attraction immediately after unsealing.

The attracting force of the coated sheet at the time of the attraction immediately after unsealing is eliminated immediately after air is blown to loosen the sheets, but re-attraction gradually begins with elapse of time, and a considerable attracting force is generated although it is smaller than the attracting force immediately after unsealing. Hereinbelow, the attraction phenomenon is referred to as re-attraction after standing.

Such re-attraction after standing as well as attraction immediately after unsealing become a cause of double feeding and miss feeding of sheets.

Thus, in this embodiment, if the cassette 100 housing coated sheets immediately after unsealing is attached to the cassette housing portion 1005, an operation of initially blowing air for a predetermined time T1 to sufficiently loosen the coated sheets is performed when the sheet surface (top surface) of the coated sheet is detected by the sheet surface position sensor 14, i.e. the coated sheet reaches a position allowing the sheet to be fed. This operation is hereinbelow referred to as an initial swing operation.

An operation of blowing air for a predetermined time T2 to sufficiently loosen coated sheets is performed before a sheet feed operation is started for eliminating re-attraction of coated sheets after standing. This operation is hereinbelow referred to as a pre-job swing operation. Further, in the case of coated sheets, very strong attraction occurs under a high-humidity environment while no attraction occurs under a low-humidity environment as described previously, and therefore the temperature for temperature-control of the heater 6 is set according to each environment.

Thus, performing at least one of the initial swing operation and the pre-job swing operation before the sheet feed operation is started, sheets can reliably be loosened at the time of feeding the sheets. In the present invention, the time before the sheet feed operation is started is the time when a sheet for which the initial swing operation is performed reaches a position allowing the sheet to be fed. It also includes the time when a job start button as job start signal generating means for generating a job start signal for starting a job is pressed by a user for performing the pre-job swing operation as described later.

Storing means 30 shown in FIG. 4 stores control tables for the optimum air blowing time (initial swing time T1 and pre-job swing time T2) and the temperature of air (temperature for temperature-control of the heater 6) created with consideration given to influences on transformability in each environment under which the sheet feeding apparatus 1002 is used, specifically an initial swing operation time (air blowing time) T1 control table, a pre-job swing operation time (air blowing time) T2 control table, and a heater temperature-control (heating temperature) control table.

One example of the control table for initial swing time (T1) is shown in FIG. 12, one example of the control table for pre-job swing time (T2) is shown in FIG. 13, and one example of the control table for the temperature for temperature-control of the heater 6 is shown in FIG. 14.

Assume that the sheet set in the cassette 100 is set to, for example, a coated sheet by a sheet type input portion 21 of an operation portion shown in FIG. 4. In this case, initial swing is performed for the predetermined time T1 according to environmental conditions in the cassette housing portion 1005 or the cassette 100 at the time when the cassette 100 is attached to the cassette housing portion 1005. At the same time, the quantity (strength) of blown air is controlled in first and second blowing force determination operations described later. For sheets composed of a resin material, such as an OHP and an art film, it is not necessary to perform initial swing and pre-job swing because the state of the sheet does not significantly vary depending on the environment and neither attraction immediately after unsealing nor attraction after standing occurs in a high-humidity environment.

Figure 6:
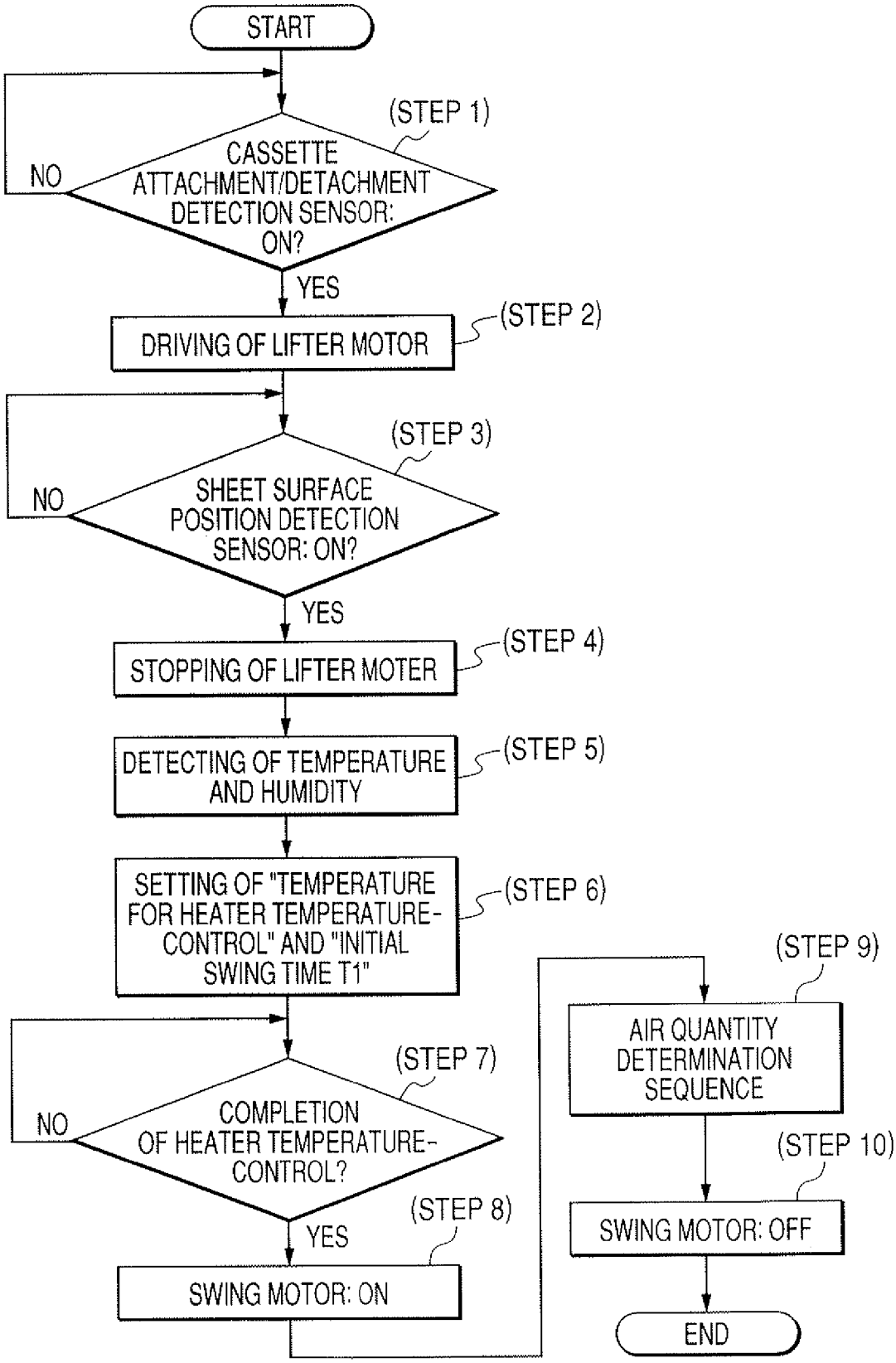
FIG. 6 is a flow chart showing an initial swing operation of the sheet feeding apparatus.

An example of carrying out an air quantity determination sequence of the present invention during the initial swing operation will now be described using the flow chart shown in FIG. 6.

The cassette 100 housing coated sheets immediately after being taken out by unsealing the wrapping paper is attached to the cassette housing portion 1005. When the cassette attachment/detachment detection sensor 17 detecting this state is turned ON (Y of step 1), the controller 120 drives the lifter motor 18 to rotate in a direction causing the sheet tray 16 to be lifted (step 2). Then, the sheet surface position is gradually-lifted with the sheet tray 16, and when the sheet surface position detection sensor 15 is turned ON by detecting the sheet surface (Y of step 3), the lifter motor 18 is stopped (step 4).

A temperature and a humidity in the cassette housing portion (cassette 100) are detected by the temperature and humidity sensor 108 (step 5). Based on the detected temperature and humidity, and the type of sheets input from the sheet type input portion 21, the controller 120 calls temperature data for temperature-control of the heater 6 appropriate to the coated sheet and data for air blowing time T1 from predetermined control tables, and sets the temperature for temperature-control of the heater 6 and the initial swing time T1 (step 6) Then, first, a current is passed through the heater 6 via the heater driver circuit 6*a* (see FIG. 4), and temperature-control of the heater 6 is performed (step 7).

Next, when temperature-control of the heater 6 is completed (Y of step 7), the swing motor 13 is turned ON (step 8), and an air quantity determination sequence for determining the quantity of air as a blowing force for raising the sheet by substantially a fixed amount (specified amount) as described later is carried out. When an air quantity for raising the sheet by substantially a fixed amount is determined by such an air quantity determination sequence, the air quantity is stored in the storing means 30 and the swing motor 6 is turned OFF (stopped) (step 10).

Heated air is blown to coated sheets housed in the cassette 100 immediately after unsealing as such, whereby attraction between coated sheets can be eliminated, and at the same time, the coated sheets can reliably and appropriately be loosened. In this way, highly reliably sheet feeding free from occurrence of a jam and double feeding is possible.

The air quantity determination sequence will now be described using the flow chart shown in FIG. 7.

When the air quantity sequence is started, the fans 4 and 5 are first turned ON (step 31). When the fans 4 and 5 are thus turned ON, voltages applied to fan motors 4A and 5A driving the fans 4 and 5 are set to a maximum value (maximum level), whereby the fans 4 and 5 rotate at a maximum number of rotations and the air quantity becomes a maximum air quantity (=Max level). Then, when the initial swing time T1, i.e. the time T1 over which the swing operation is carried out a predetermined number of times (e.g. two or three times), elapses (Y of step 32), whether or not the rising detection sensor 51 detects the rising of the sheet is determined (step 33).

If the rising detection sensor 51 is turned on by detecting the rising of the sheet (Y of step 33), it is determined that the air quantity is too large. The levels of voltages applied to the fan motors 4A and 5A are set to −1 level to reduce (down) the quantity of air (step 36), the swing operation for the predetermined time T1 is performed again, and a determination is then made on the rising of the sheet by the rising detection sensor 51 (step 33).

Because the voltage is not proportional to the quantity of air, the amount of change in voltage for changing the quantity of air by a fixed amount is not constant. Therefore, the amount of change in voltage for adjusting the quantity of air by a fixed amount is expressed as applied voltage levels (+3, +2, +1, 0, −1, −2, −3). Namely, the quantity of air increases by a fixed amount each time the applied voltage level is increased by one level, and the quantity of air decreases by a fixed amount each time the applied voltage level is decreased by one level.

If this operation is repeated, the air quantity gradually decreases, and the amount of rising of the sheet accordingly decreases, and when the rising detection sensor 51 is no longer turned ON (N of step 33), the air quantity at this time is determined to be an optimum air quantity for raising the sheet by substantially a fixed amount (step 34). Further, after the optimum air quantity is thus determined, in other words, after optimum values of voltages applied to the fan motors 4A and 5A are determined, the fans 4 and 5 are turned OFF (stopped) (step 35). The optimum air quantity determined at this time is stored in the storing means 30. In this sequence, air is blown to the sheet during the initial swing time T1 necessary at the minimum, and therefore the initial swing has sufficient effect.

By blowing air in the optimum air quantity thus obtained when the sheet is fed, the strength with which air is blown, namely the air quantity, is controlled so that the amount of rising of the sheet when blowing air is substantially constant. In this way, irrespective of the type of sheet and the environment, sheets can be uniformly raised and attraction between sheets can be eliminated. Thus, sheets having a high adhesiveness, such as coated sheets, can be separated and fed without impairing a set characteristic of the sheet when they are fed.

Namely, when the sheet is fed, air is blown by the fans 4 and 5 to raise the top sheet, and the quantity of air blown by the fans 4 and 5 is controlled so that the amount of rising of the top sheet is a specified amount. In this way, irrespective of the type of sheet and the environment, attraction between sheets can be eliminated, and sheets having a high adhesiveness, such as coated sheets, can appropriately be conveyed.

Such an air quantity determination sequence is not limited to the first blowing force determination operation of gradually decreasing the air quantity from the maximum air quantity and determining an optimum air quantity as described above. The optimum air quantity may be determined by, for example, the second blowing force determination operation of gradually increasing the air quantity from the minimum air quantity and determining an optimum air quantity.

Figure 8:
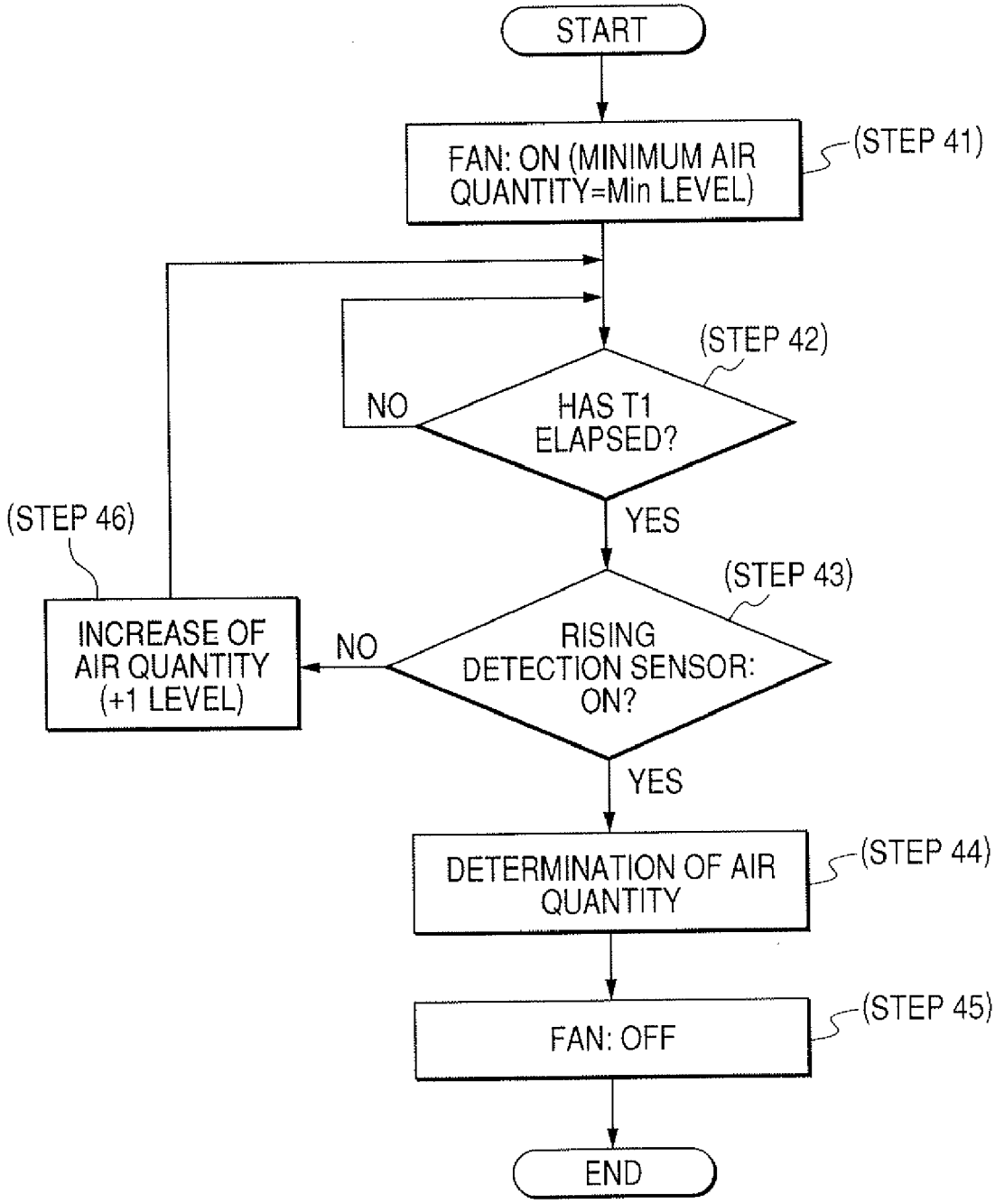
FIG. 8 is a flow chart showing an air quantity determination sequence during the initial swing operation of the sheet feeding apparatus.

FIG. 8 is a flow chart showing an air quantity determination sequence according to such a second blowing force determination operation, and in this case, voltages applied to the fan motors 4A and 5A are set to a minimum value when the fan is ON. Resultantly, the fans 4 and 5 rotate at a minimum number of rotations, and the air quantity becomes a minimum air quantity (=Min level). Then, when the time T1 over which the swing operation is performed a predetermined number of times (e.g. two or three times) elapses (Y of step 42), whether or not the rising detection sensor 51 detects the rising of the sheet is determined (step 43).

If the rising detection sensor 51 does not detect the rising of the sheet and is OFF (N of step 43), it is determined that the air quantity is too small, voltages applied to the fan motors 4A and 5A are set to +1 level to increase the air quantity (step 46), and the swing operation for the predetermined time T1 is performed again. When the predetermined time T1 elapses (Y of step 42), a determination is made on the rising of the sheet by the rising detection sensor 51 (step 43).

When this operation is repeated, the air quantity gradually increases, and the amount of rising of the sheet accordingly increases, and when the rising detection sensor 51 is turned ON from OFF (Y of step 43), the air quantity at this time is determined to be an optimum air quantity for raising the sheet by substantially a fixed amount (step 44). Further, after the optimum air quantity is thus determined, in other words, after optimum values of voltages applied to the fan motors 4A and 5A are determined, the fans 4 and 5 are turned OFF (stopped) (step 45). The optimum air quantity determined at this time is stored in the storing means 30.

Air is blown in the optimum air quantity determined by the air quantity determination sequence when the sheet is fed, whereby irrespective of the type of sheet and the environment, sheets can uniformly be raised, attraction between sheets can be eliminated, and sheets can reliably be separated one by one and delivered.

The air quantity determination sequences associated with the first and second blowing force determination operations may be switched according to ease with which sheets stacked in the cassette rise, for example, the type (size, thickness, weight and the like) of sheet. For example, when sheets having a large thickness and size are stacked, the possibility of reaching an optimum value earlier is higher if the air quantity is decreased from the maximum.

Further, if the optimum air quantity can be determined in advance according to the type (size, thickness, weight and the like) of sheet by experiments or the like, optimum values of voltages applied to the fan motors 4A and SA, which correspond to the maximum air quantity, are stored in the storing means 30 in advance. If the optimum values are called based on the type of sheet, and the fan motors 4A and 5A are rotated with the optimum values (initial set values), a practical optimum air quantity can be determined in a shorter time.

Figure 9:
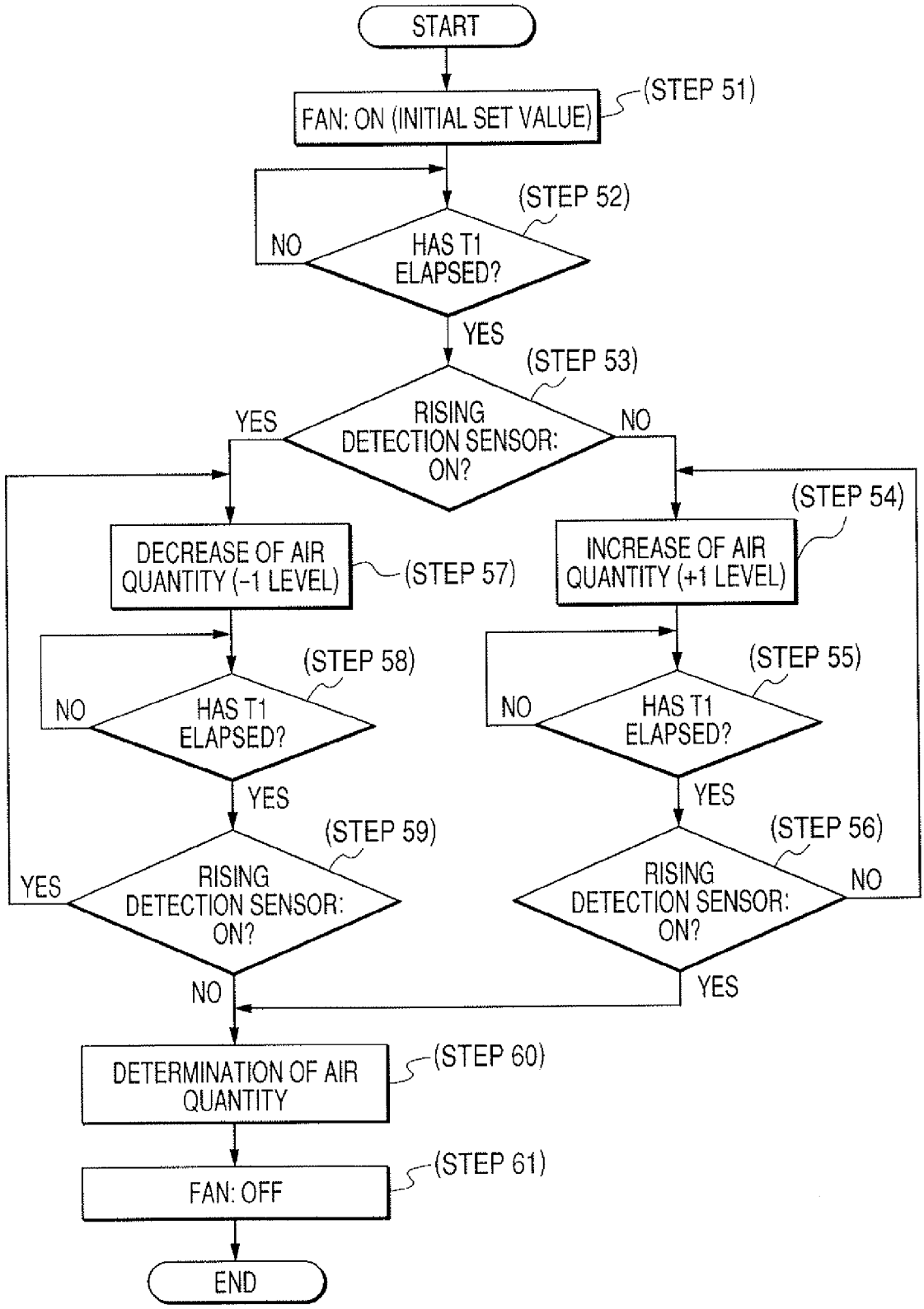
FIG. 9 is a flow chart showing an air quantity determination sequence in another embodiment during the initial swing operation of the sheet feeding apparatus.

FIG. 9 is a flow chart showing an air quantity determination sequence for determining such an optimum air quantity in a short time. When the fan is ON, voltages applied to the fan motors 4A and 5A are first set to the optimum values (initial set values) stored in the storing means 30 in advance according to the type (size, thickness and weight) of sheet to rotate the fans 4 and 5 (step 51). Next, when the initial swing time Ti elapses (Y of step 52), whether or not the rising detection sensor 51 detects the rising of the sheet is determined (step 53).

If the rising detection sensor 51 is turned ON by detecting the rising of the sheet (Y of step 53), it is determined that the air quantity is too large, and the voltages applied to the fan motors 4A and 5A are set to −1 level to decrease the air quantity (step 57). The swing operation for the predetermined time T1 is performed again (step 58), and when the predetermined time T1 elapses (Y of step 58), a determination is made on the rising by the rising detection sensor 51 (step 59).

When this operation is repeated, the air quantity gradually decreases, and the amount of rising of the sheet accordingly decreases, and when the rising detection sensor 51 is no longer turned on (N of step 59), the air quantity at this time is determined to be an optimum air quantity for raising the sheet by substantially a fixed amount (step 60). Then, the fans 4 and 5 are turned OFF (stopped) (step 61).

When the initial swing time T1 elapses (Y of step 52), and if the rising detection sensor 51 does not detect the rising of the sheet and is OFF (N of step 53), it is determined that the quantity of air is too small, the voltages applied to the fan motors 4A and 5A is set to +1 level to increase the air quantity (step 54), and the swing operation for the predetermined time T1 is performed again. When the predetermined time T1 elapses (Y of step 55), whether or not the rising detection sensor 51 has been turned ON is determined by the rising detection sensor 51 (step 56).

When this operation is repeated, the air quantity gradually increases, and the amount of rising of the sheet accordingly increases, and when the rising detection sensor 51 is turned ON (Y of step 56), the air quantity at this time is determined to be an optimum air quantity for raising the sheet (step 60) After the optimum air quantity is thus determined in other words, after optimum values of applied voltages are determined, the fans 4 and 5 are turned OFF (stopped) (step 61).

Air is blown in the optimum air quantity determined by the air quantity determination sequence when the sheet is fed, whereby irrespective of the type of sheet and the environment, sheets can be raised uniformly to eliminate attraction between the sheets, and thus the sheets can reliably be separated one by one and delivered.

Thus, by setting the quantity of air at an initial time to an initial set value determined by experiments, a preset optimum quantity of air can be corrected in a short time, and an optimum quantity of air appropriate to the state can be obtained.

If the optimum quantity of air cannot be obtained during the predetermined initial swing time, a job start may be prohibited from being accepted until the initial swing operation is completed. A job may be started after an operation for obtaining the optimum quantity of air is completed after the job start is accepted.

Figure 10:
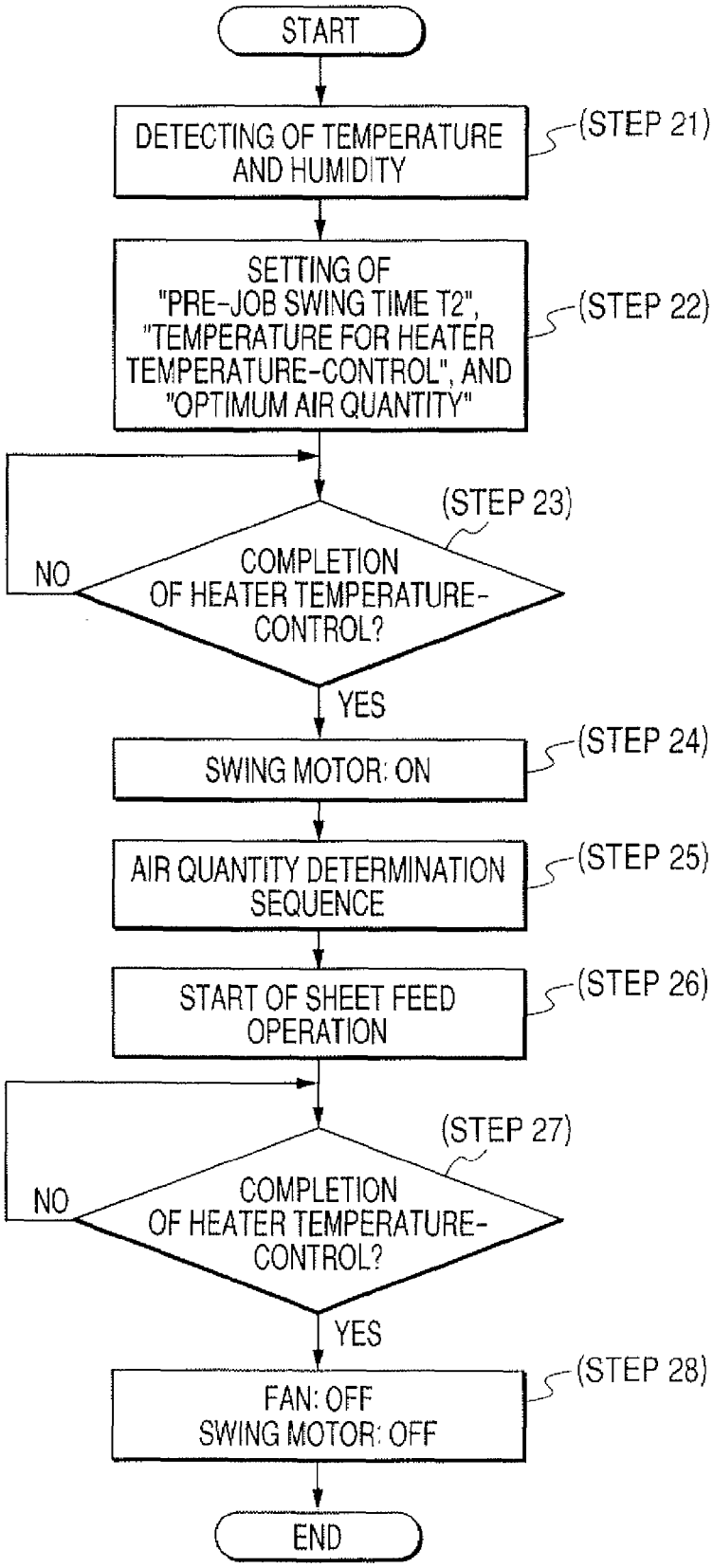
FIG. 10 is a flow chart showing an air quantity determination sequence in another embodiment during the initial swing operation of the sheet feeding apparatus.

An example of carrying out the air quantity determination sequence during the pre-job swing operation performed prior to the start of the sheet feed operation for eliminating re-attraction after standing will now be described using the flow chart shown in FIG. 10. For this control, an optimum quantity of air is also determined in advance according to the type (size, thickness, weight and the like) of sheet by experiments or the like, and optimum values of voltages applied to the fan motors 4A and 5A, which correspond to the optimum air quantity, are stored in the storing means 30 in advance.

When the job start button as job start signal generating means for generating a job start signal for starting a job is pressed by the user, a temperature and a humidity in the cassette housing portion (cassette 100) are first detected by the temperature and humidity sensor 108 (step 21). The controller 120 calls data of the pre-job swing time T2 and the temperature for temperature-control of the heater 6 from the control table based on the detected temperature and humidity. Further, the optimum values of voltages stored in advance and determined by experiments and the like are called, and the per-job swing time T2, the temperature for temperature-control of the heater 6, and the optimum values of voltages are set (step 22).

Next, a current is first passed through the heater 6 to perform temperature-control of the heater 6 based on the called data for the temperature for temperature-control, and when the temperature-control of the heater 6 is completed (Y of step 23), the fans 4 and 5 are turned ON based on the set optimum values of voltages. Further, the swing motor 13 is turned ON (step 24). Next, the air quantity determination sequence for correction is carried out (step 25).

Then, when the pre-job swing time T2 obtained by the control table elapses, the sheet feed operation is started (step 26). When a predetermined job is completed, namely when the last sheet of the job is fed (Y of step 27), the fans 4 and 5 and the switching motor 6 are turned off (stopped) (step 28). After standing as such and before the sheet feed operation is started, heated air is blown to coated sheets, whereby re-attraction can be eliminated, and the coated sheets can reliably be loosened.

The air quantity determination sequence during the pre-job swing operation will now be described using FIG. 11. For this control, as described above, an optimum quantity of air is determined in advance according to the type (size, thickness and weight) and the like of sheet by experiments or the like, and optimum values of voltages applied to the fan motors 4A and 5A, which correspond to the optimum air quantity, are stored in the storing means 30 in advance. Optimum values are called based on the type of sheet, the fan motors 4A and 5A are rotated with the optimum values (initial set values), and a practical optimum air quantity can be determined in a shorter time.

While the fans 4 and 5 are rotated with voltages of the stored optimum values, a determination is made on the rising by the rising detection sensor 51 (step 83) after the pre-job swing time T2 elapses (Y of step 82).

If the rising detection sensor 51 is turned on (Y of step 83), it is determined that the air quantity is too large, the voltages applied to the fan motors 4A and 5A are set to −1 level to decrease the air quantity (step 87), and the pre-job swing operation for the predetermined time T2 is performed again (step 88). When the predetermined time T2 elapses (Y of step 88), a determination is made on the rising by the rising detection sensor 51 (step 89).

When this operation is repeated, the air quantity gradually decreases, and the amount of rising of the sheet accordingly decreases, and when the rising detection sensor 51 is no longer turned ON (N of step 89), the air quantity at this time is determined to be an optimum air quantity (step 90). Then, this optimum air quantity Is stored in the storing means 30.

When the pre-job swing time T2 elapses (Y of step 82), and if the rising detection sensor 51 does not detect the rising of the sheet and is OFF (N of step 83), it is determined that the quantity of air is too small. The voltages applied to the fan motors 4A and 5A are set to +1 level to increase the air quantity (step 84), and the pre-job swing operation for the predetermined time T2 is performed again. When the predetermined time T2 elapses (Y of step 85), whether or not the rising detection sensor 51 has been turned ON is determined by the rising detection sensor 51 (step 86).

This operation is repeated, and when the rising detection sensor 51 is turned ON (Y of step 86), the air quantity at this time is determined to be an optimum air quantity for raising the sheet (step 90) Then, the optimum air quantity is stored in the storing means 30. Air is blown in the optimum air quantity determined by the air quantity determination sequence when the sheet is fed, whereby irrespective of the type of sheet and the environment, sheets can be raised uniformly to eliminate attraction between the sheets, and thus the sheets can reliably be separated one by one and delivered.

Thus, by blowing air to the side face of the sheet S for the predetermined time T1, T2 when the sheet reaches a position allowing the sheet to be fed and before the sheet feed operation is started, image defects such as improper transfer do not occur. Various sheets such as coated sheets, OHP and art films and very thick sheets can reliably be separated and fed.

By setting the temperature for temperature-control of the heater 6 based on a signal from the temperature and humidity sensor 108 provided near the cassette 100, high-quality images free from image defects such as improper transfer can be provided together with a feeding performance.

Figure 7:
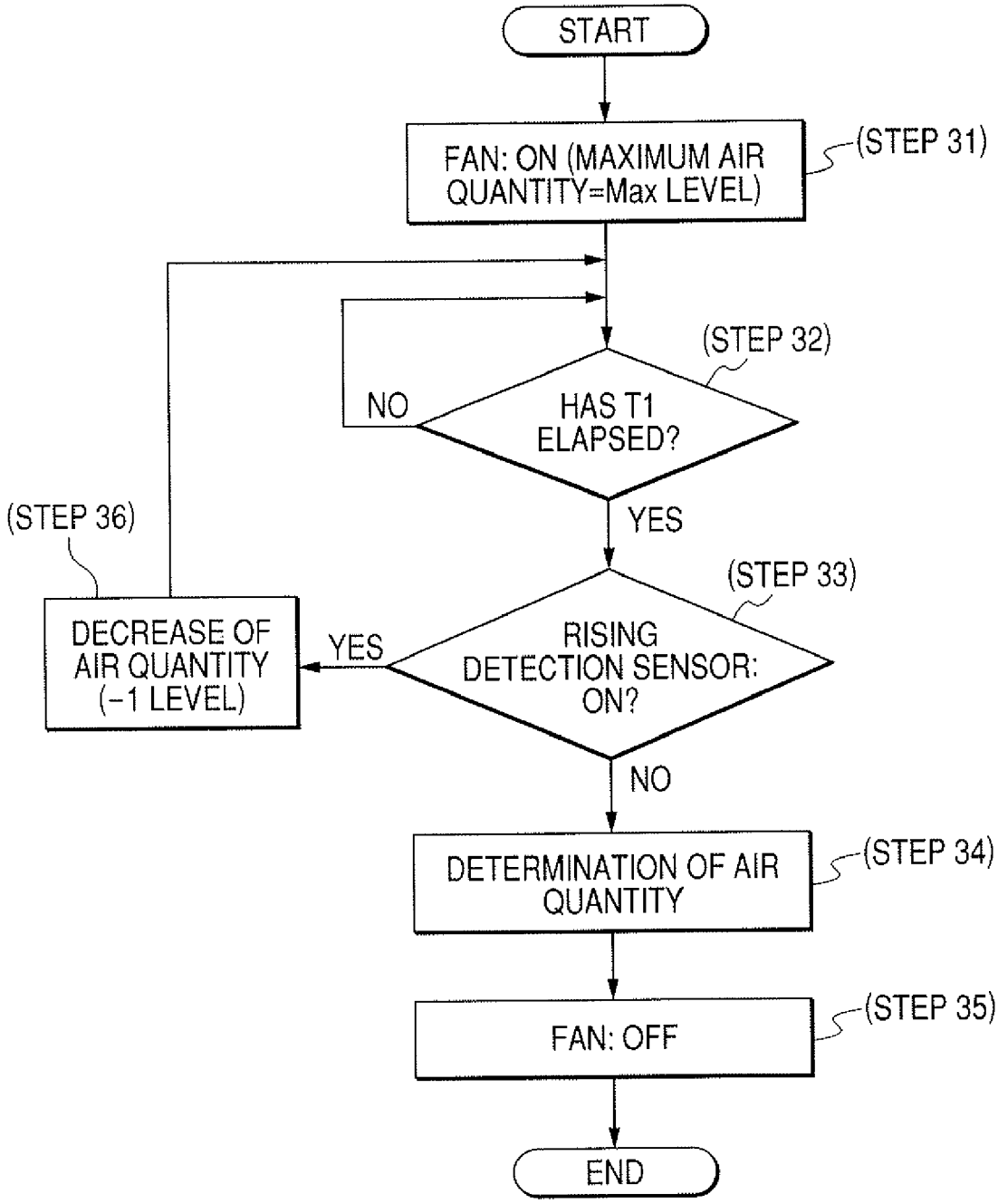
FIG. 7 is a flow chart showing a pre-job swing operation of the sheet feeding apparatus.
Figure 11:
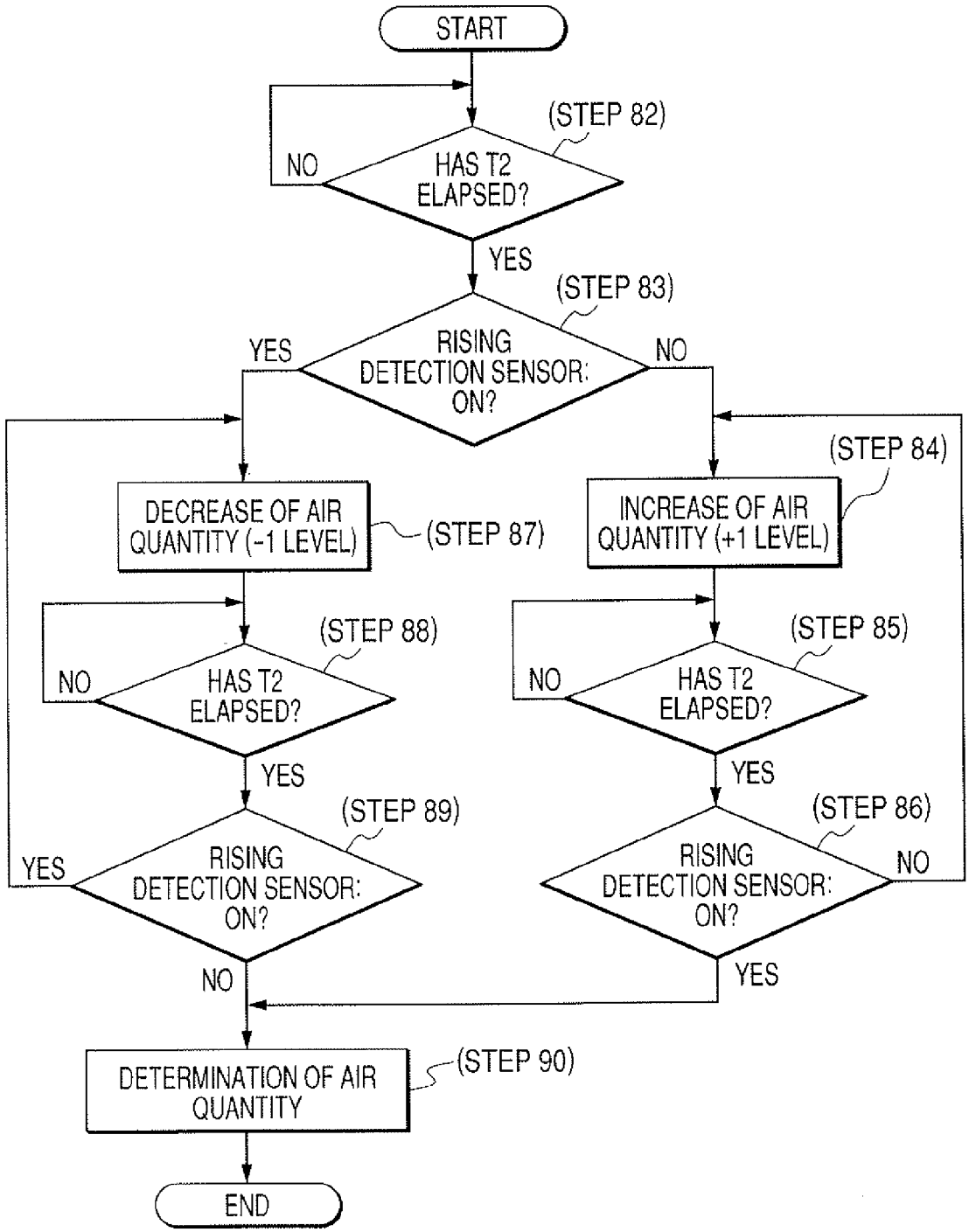
FIG. 11 is a flow chart showing an air quantity determination sequence during the pre-job swing operation of the sheet feeding apparatus.
Figure 15:
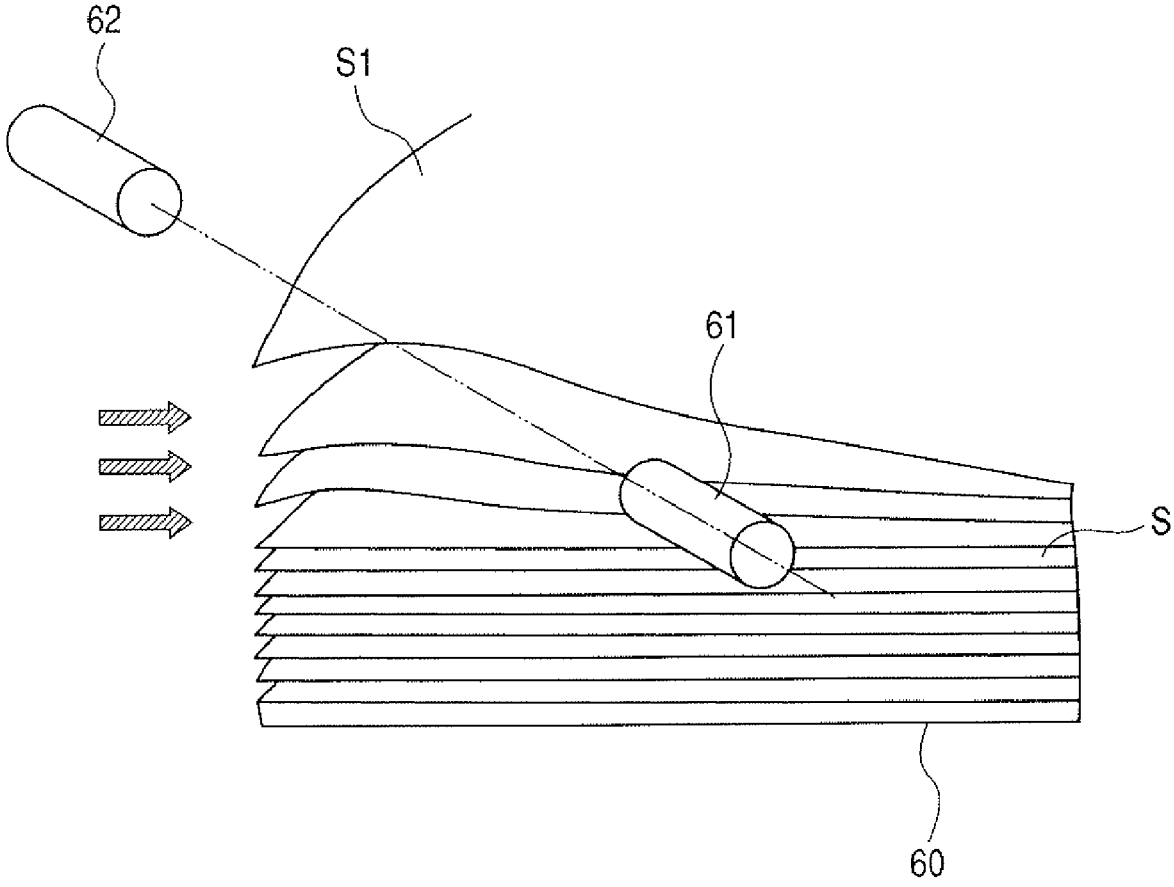
FIG. 15 is a view explaining the configuration of a conventional sheet feeding apparatus.

For the air quantity determination sequence shown in FIG. 11, control is started by rotating the fan motors 4A and 5A with voltages of optimum values appropriate to the sheet in advance to determine an optimum air quantity in a short time, but control same as the control described with FIG. 7 or 8, which is performed during initial swing, may be performed during per-job swing. Namely, the optimum air quantity may be determined by rotating the fan with a maximum air quantity and gradually decreasing the air quantity, or the optimum air quantity may be determined by rotating the fan with a minimum air quantity and gradually increasing the air quantity.

Up to this point, the case where an air quantity determination sequence for determining an optimum air quantity when performing initial swing or pre-job swing is carried out at the time of attachment of the cassette and before the start of the sheet feed operation has been described, but the present invention is not limited thereto. For example, the air quantity determination sequence may be carried out separately, independently of initial swing or pre-job swing. Namely, for example, the optimum air quantity is determined by carrying out the air quantity determination sequence after initial swing or pre-job swing is completed.

In this embodiment, control when coated sheets are used has been described in detail, but the present invention is not limited thereto, and control tables may be created for sheets other than coated sheets, i.e. OHP and art films, very thick sheets and other plain papers, having different environment-dependent characteristics. For example, as described previously, in the case of OHP films and art films, air may be blown with a high air strength in a low-humidity environment because attraction by charging occurs under a low-humidity environment, and air may be blown with a low air strength under a high-humidity environment because the attraction by charging described above hardly occurs. Since these sheets composed of resin materials do not take up moisture, it is not necessary to use hot air, and therefore the heater may be set OFF.

Thus, control tables for the temperature for heater temperature-control, the air speed, the air blowing time and the like which are optimum for each material are created, and the sheet type input portion 21 is provided as sheet type inputting means as shown-in FIG. 4. The controller 120 may select an optimum time control table from a plurality of time control tables according to sheet type information from the sheet type input portion 21 and use the selected table.

Since coated sheets have different attraction characteristics and transfer characteristics according to their types and brands, optimum control tables may be provided according to types and brands of coated sheets. In this way, reliable optimum conditions for feeding the sheet can be obtained in a shorter time, and a high-reliable sheet feeding apparatus can be provided.

Further, for rewriting data of tables for time control and control for temperature-control and adding a table, a data input portion 22 is provided as shown in FIG. 4. A user or a serviceman may also freely create the previously described control tables via the data input portion 22 according to respective purposes and store the same.

In the embodiment described above, a configuration in which the fans 4 and 5 and the air blowing ports 2*a* and 2*b* are placed on the side of a sheet stack stacked on the sheet tray 16 (at one end portion in-the width direction of sheets) to blow air to the side end of the sheet stack has been disclosed, but the present invention is not limited thereto. For example, the present invention may be applied to, for example, a configuration in which an air blowing port is provided on the front side in the direction of feeding stacked sheets to blow air to the end portion on the front side of the sheet stack.

In this embodiment, as the sheet feeding apparatus 1002, a sheet feeding apparatus having a configuration in which the pickup roller 101 is used as sheet feeding device to feed sheets has been described as an example, but the sheet feeding apparatus may use a conveying belt attracting a rising sheet and conveying it as sheet feeding device. Further, as sheet separating device, the retard system has been described as one example, but this may be the separation pad system or the air sheet blowing system.

This application claims priority from Japanese Patent Application No. 2005-029806 filed on Feb. 4, 2005, which is hereby incorporated by reference herein.

What is claimed is:

1. A sheet feeding apparatus comprising:

a sheet tray capable of moving up and down;

a sheet feeding device capable of a sheet feeding operation for feeding a top sheet of a sheet stack supported on said sheet tray;

an air blowing device capable of blowing air toward an end portion of said sheet stack at adjustable velocities; and a sheet detecting device capable of detecting the top sheet of the sheet stack supported on said sheet tray when the top sheet is blown upward by air blown by said air blowing device, wherein said apparatus is controlled so that said sheet tray is lifted up until the top sheet of the sheet stack reaches a predetermined position, then air is blown toward an end portion of said sheet stack by said air blowing device to blow the sheets upward, and thereafter a quantity of air blown by said air blowing device is adjusted so that an amount of air blowing toward the top sheet becomes a predetermined amount based on the detection of the sheet detecting device, and wherein said air blowing device blows air toward the sheet stack based on the adjusted quantity of air blown while said sheet feeding device feeds the sheet during the sheet feeding operation.

2. The sheet feeding apparatus according to claim 1, wherein the quantity of air blown by said air blowing device is determined in response to a signal from the sheet detecting device.

3. The sheet feeding apparatus according to claim 2, wherein the strength of air blown by said air blowing device at the time of the start of control is set to a strength at which the sheet is detected by said sheet detecting device, the strength of air blown by said air blowing device is then gradually decreased, and the strength of air when a sheet detection signal is no longer output from said sheet detecting device is determined to the quantity of air blown by said blowing device as the amount of blowing upward of said top sheet becomes a specified amount.

4. The sheet feeding apparatus according to claim 2, wherein the strength of air blown by said air blowing device at the time of the start of control is set to a strength at which the sheet is not detected by said sheet detecting device, the strength of air blown by said air blowing device is then gradually increased, and the strength of air when a sheet detection signal is output from said sheet detecting device is determined to the quantity of air blown by said blowing device as the amount of blowing upward of said top sheet becomes a specified amount.

5. The sheet feeding apparatus according to claim 2, wherein the strength of air blown by said air blowing device at the time of the start of control is set to a predetermined value, and if the sheet blowing upward by air blown by said air blowing device is detected by said sheet detecting device, the strength of air blown by said air blowing device is then gradually decreased, and the strength of air when a sheet detection signal is no longer output from said sheet detecting device is determined to quantity of air blown by said blowing device as the amount of blowing upward of said top sheet becomes a specified amount, and if the sheet blowup up by air blown by said air blowing device at the time of the start of control is not detected by said sheet detecting device, the strength of air blown by said air blowing device is then gradually increased, and the strength of air when a sheet detection signal is output from said sheet detecting device is determined to the quantity of air blown by said blowing device as the amount of blowing upward of said top sheet becomes a specified amount.

6. The sheet feeding apparatus according to claim 5, wherein said predetermined value of the strength of air blown at the time of the start of control is preset according to the type of sheets that are fed.

7. The sheet feeding apparatus according to claim 1, wherein control for determining a strength of air by which the amount of blowing upward of said top sheet becomes a specified amount is performed during an initial swing operation of blowing air for a fixed time when sheets are filled in said sheet tray.

8. The sheet feeding apparatus according to claim 1, wherein control for determining a strength of air by which the amount of blowing upward of said top sheet becomes a specified amount is performed during a pre-job swing operation of blowing air for a fixed time when said sheet feeding device feeds sheets stacked on said sheet tray.

9. An image forming apparatus comprising:

the sheet feeding apparatus set out in any one of claims 1 to 8; and an image forming portion forming an image on a sheet delivered from said sheet feeding apparatus.

* * * * *

UNITED STATES PATENT AND TRADEMARK OFFICE

CERTIFICATE OF CORRECTION

PATENT NO. : 7,419,152 B2
APPLICATION NO. : 11/275790
DATED : September 2, 2008
INVENTOR(S) : Adachi It is certified that error appears in the above-identified patent and that said Letters Patent is hereby corrected as shown below:

COLUMN 1:
Line 61, “nature” should read --nature,--.

COLUMN 2:
Line 53, “heavy” should read --heavy,--.
Line 63, “so called” should read --so-called--.

COLUMN 3:
Line 25, “as” should read --as the--.

COLUMN 4:
Line 31, “image forming portion 1003” should read --image forming portion 1003,--.
Line 36, “device” should read --devices,--.
Line 57, “same” should read --the same--.

COLUMN 5:
Line 24, “fixing apparatus 113” should read --fixing apparatus 118--.

COLUMN 6:
Line 20, “detection sensor 17” should read --detection sensor 17,--.

COLUMN 7:
Line 21, “i.e.” should read --i.e.,--.

COLUMN 8:
Line 23, “miss feeding” should read --misfeeding--.

COLUMN 9:
Line 59, “reliably” should read --reliable--.

COLUMN 11:
Line 21, “by substantially” should read --substantially by--.

COLUMN 12:
Line 6, “by substantially” should read --substantially by--.
Line 23, “determined” should read --determined,--.

UNITED STATES PATENT AND TRADEMARK OFFICE

CERTIFICATE OF CORRECTION

PATENT NO. : 7,419,152 B2
APPLICATION NO. : 11/275790
DATED : September 2, 2008
INVENTOR(S) : Adachi It is certified that error appears in the above-identified patent and that said Letters Patent is hereby corrected as shown below:

COLUMN 13:
Line 58, "(step 90)" should read --(step 90).--.

COLUMN 15:
Line 4, "in-the" should read --in the--.

COLUMN 16:
Line 3, "to" should read --by--.
Line 13, "to" should read --by--.
Line 24, "to" should read --by--.
Line 26, "blowup up" should read --blows up--.
Line 31, "to" should read --by--.

Signed and Sealed this

Third Day of February, 2009

John Doll

JOHN DOLL
*Acting Director of the United States Patent and Trademark Office*